US005255438A

United States Patent [19]

Morgan

[11] Patent Number: 5,255,438

[45] Date of Patent: Oct. 26, 1993

[54] COMBINATION KNIFE AND SHEARS APPARATUS

[76] Inventor: Ronnie F. Morgan, 541 Mt. Sinai Rd., Foxworth, Miss. 39483

[21] Appl. No.: 10,612

[22] Filed: Jan. 28, 1993

[51] Int. Cl.[5] ..... B26B 13/00

[52] U.S. Cl. ..... 30/254; 30/239; 30/244

[58] Field of Search ..... 30/239, 237, 244, 194, 30/254, 204, 266, 238, 240, 249

[56] References Cited

U.S. PATENT DOCUMENTS

| | | | |
|---|---|---|---|
| 1,301,753 | 4/1919 | Seniw | 30/146 |
| 1,771,031 | 7/1930 | Court | 30/146 |
| 2,313,651 | 3/1943 | Lutman | 30/239 |
| 2,674,796 | 4/1954 | Herold | 30/146 |
| 2,875,520 | 3/1959 | Webster | 30/254 |
| 3,835,533 | 9/1974 | Granson | 30/146 |
| 4,037,276 | 7/1977 | Brinker | 30/254 |
| 4,809,433 | 3/1989 | Maxwell et al. | 30/254 |
| 5,079,801 | 1/1992 | Peterson | 30/146 |

FOREIGN PATENT DOCUMENTS

| | | | |
|---|---|---|---|
| 29435 | 11/1884 | Fed. Rep. of Germany | 30/146 |
| 3357 | of 1886 | United Kingdom | 30/146 |
| 11808 | of 1912 | United Kingdom | 30/13 |

*Primary Examiner*—Douglas D. Watts
*Assistant Examiner*—Paul M. Heyrana, Sr.
*Attorney, Agent, or Firm*—Pravel, Hewitt, Kimball & Krieger

[57] ABSTRACT

A composite knife and shears apparatus provides a larger knife blade and a smaller knife blade that closely conform in a closed position so that the smaller knife is contained within the periphery of the larger knife. A pair of handle members form handles for the shears in open position and abut to define an overall composite handle with generally continuous outer surface in a folded, closed position. The top of the larger blade has a recess that holds an object to be sheared.

15 Claims, 1 Drawing Sheet

COMBINATION KNIFE AND SHEARS APPARATUS

BACKGROUND OF THE INVENTION

1. Field Of The Invention

The present invention relates to knives and more particularly to an improved knife and shears apparatus, that includes a smaller knife member that pivots upon a larger knife member and wherein the two knife members nest together in a closed position so that the blade of the smaller knife is completely contained within the periphery of the blade of the larger knife. The knife apparatus provides a handle that includes a larger handle and a smaller handle, each having corresponding abutting surfaces that engage when the knife is in a closed position to thereby rigidify the handle.

2. General Background

Many types of knives have been manufactured and sold which afford both the function of a knife and that of scissors or shears. The most common example of such a knife is a multiple blade pocket knife arrangement that includes one or two knife elements and separate scissor elements. These pocket knife devices having multiple blades are typically restricted to cutting small objects because the individual blade and scissor elements are relatively small, as the concept is to combine a large plurality of knife elements in a single pocket knife.

One of the problems incurred by outdoorsmen and hunters is that a knife blade alone is usually not suitable for cutting objects that need to be sheared, such as small tree limbs, large diameter rope, bone, and the like. Deer hunters using tree stands, for example, must frequently cut small limbs to provide a better view.

Many patents have been issued on knives that include both a knife blade and an auxiliary blade that defines scissors with the primary blade. An early example is U.S. Pat. No. 3,357 entitled "Improvements in Knives". The '357 Patent has a larger blade and a smaller blade which is pivotally attached to the larger blade. The smaller blade extends above the surface of the larger blade in a closed retracted position.

A bayonet is the subject of U.S. Pat. No. 1,301,753. The apparatus includes a pivot that joins a pair of knife sections together so that the two knife portions can be manipulated as a shear for cutting objects such as barbed wire.

Another combination knife and scissors is shown in U.S. Pat. No. 1,771,031. In that device, the two knife blades are of equal length and have cutting edges that abut in a closed position so that each of the knives in combination provides an overall larger dimension to the apparatus in closed position.

A pivoted utility cutting tool having a latching mechanism is seen in U.S. Pat. No. 2,674,796 issued to H. G. Herold. The Herold device is especially designed for use by electricians to cut and strip insulation from electric wires or other similar operations and wire handling.

U.S. Pat. No. 3,835,533 discloses a combination knife and shear. The implement basically comprises a pair of blade members that may be interlocked in a first position to form a knife and that may alternatively be joined by a pivot pin to form a scissors or shear.

A dagger in the form of scissors is disclosed in U.S. Pat. No. 5,079,801 entitled "Protection Scissors". The apparatus includes blades sharpened with outer edges and handles functioning as brass knuckles. A British patent 11,808 entitled "Combination Grape-Cutter and Fruit Knife" provides a pair of spaced apart handles similar to the handles of a pair of pliers. Each handle carries a knife member including a larger knife member on one handle and a smaller, shorter knife member on another handle. The blade of the sharp knife has a concavely shaped cutting edge.

A German patent 29,435 discloses another cutting instrument having a pair of handled members and a pair of blade members. The blade members each provide cutting edges which communicate as the device is closed. One of the cutting blades has a concavely-shaped cutting edge and the other provides a convexly-shaped cutting edge.

SUMMARY OF THE PRESENT INVENTION

The present invention provides an improved cutting knife apparatus that is a combination knife and shears. The apparatus includes a knife main body having a first larger handle and a first blade member, the blade having a cutting edge along its entire length.

A knife secondary body provides a second smaller handle and a second blade member that is shorter than the first blade member.

A pivot is mounted on the knife main body for pivotally joining the main body and the primary body.

The main and secondary bodies are pivotally movable relative to one another between folded and extended positions.

The larger and smaller handles each provide cooperating abutting surfaces that closely engage when in folded position. A recess on the larger handle includes a vertical surface that is generally flat and a horizontal surface that is also generally flat and which intersects the vertical surface at generally right angles. The smaller handle is generally rectangular in transverse cross section and sized to fit in the recess of the larger handle.

The second blade member and the first blade member define therebetween a pair of shearing surfaces for cutting objects placed therebetween in the extended position and when the blade members are moved toward the folded position.

The first and second handles nest together in the folded position and form a single handle member with a generally rectangular transverse cross section and providing a generally continuous outer surface that can be gripped by the hand of the user.

The first and second blades have corresponding side portions that abut in the folded position.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
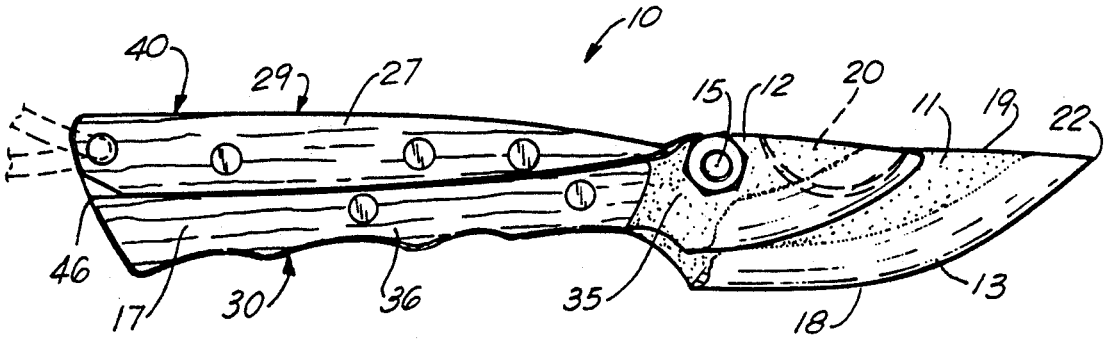
FIG. 1 is a front elevational view of the preferred embodiment of the apparatus of the present invention shown in closed position.

FIG. 1 illustrates the preferred embodiment of the apparatus of the present invention designated generally by the numeral 10. Knife apparatus 10 includes a larger knife portion 11 and a smaller knife portion 12. The larger knife portion provides a larger blade 13. Similarly, the smaller knife portion 12 provides a smaller blade 14. The smaller blade 14 is sized and shaped to fit within the confines of the periphery of larger blade 13 when in a closed position as shown in FIG. 1. The periphery of larger blade 13 is defined by upper edge 19 and convex cutting edge 18. The upper edge 19 and convex cutting edge 18 meet at point 22.

The smaller blade 14 also includes an upper edge 24 and a convex cutting edge 26. The upper edge 24 and convex cutting edge 26 of smaller blade 14 converge at point 25. Larger knife portion 11 provides a concave recess 20 that begins adjacent pivot 15 and extends about half the distance between pivot 15 and point 22. The concave recess 20 is covered by smaller blade 14 when knife 10 is in the closed position (see FIG. 1). The pointed end 25 of smaller blade 14 extends a distance from pivot 15 that is greater than the distance the recess 20 extends from pivot 15.

Figure 2:
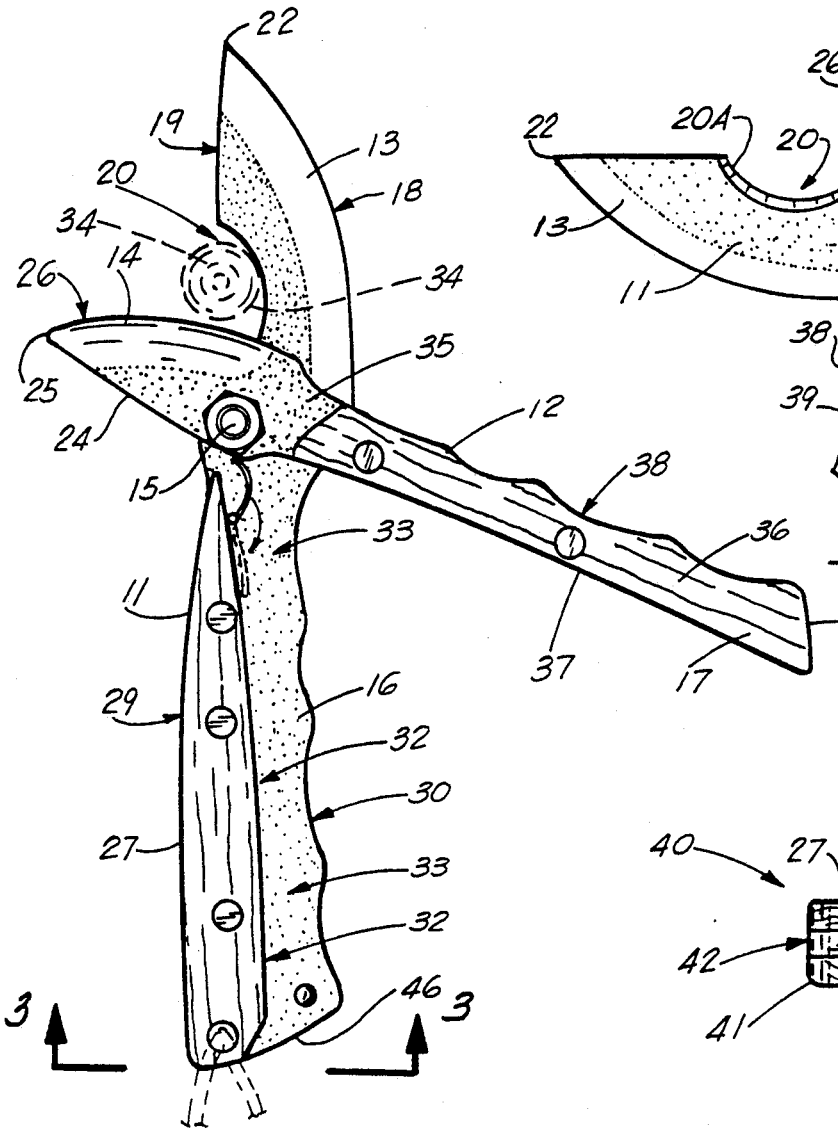
FIG. 2 is a front elevational view of the preferred embodiment of the apparatus of the present invention shown in open, cutting position.
Figure 4:
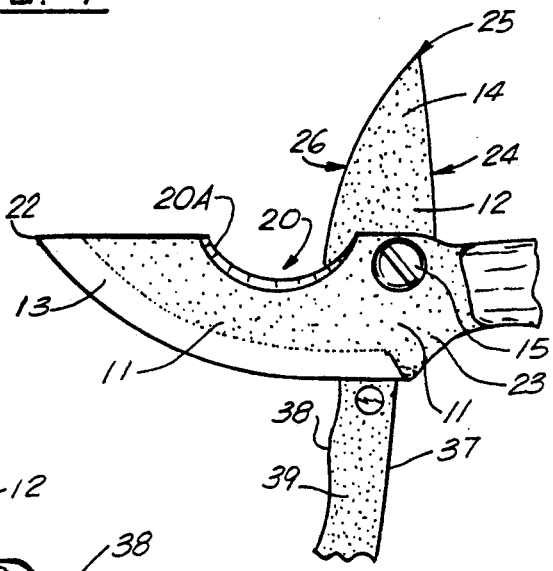
FIG. 4 is a fragmentary view of the preferred embodiment of the apparatus of the present invention shown in open, cutting position.

When an object 34 to be cut is placed in recess 20 (see FIG. 2) the convex cutting edge 26 of smaller blade 14 will shear the object 34 as the object 34 nests in recess 20. Recess 20 can be provided with a cutting edge 20A if desired. The cutting edge 20A can be used as a gut hook when the shorter, smaller blade 14 is in an open position (FIGS. 2 and 4).

Larger knife portion 11 can be constructed of a single flat metallic member that includes larger blade 13 and larger handle portion 16 with scales 27, 28 attached thereto using rivets. Similarly, smaller knife portion 12 can be of a single flat metallic blade member with scale 36 attached thereto with rivets, for example. Pivot 15 is positioned at the rear 23 of larger blade 13 and at the rear 35 of smaller blade 14. At larger handle portion 16, a pair of handle scales 27, 28 are provided. The first handle scale is a smaller scale 27 which extends about half-way between the upper surface 29 and the lower surface 30 of handle portion 16. A recess 31 is defined by the area below scale 27. The bottom of scale 27 provides a generally flat longitudinally extending surface 32 which is generally perpendicular to planar surface 33 of larger handle portion 16. A smaller blade handle portion 17 has a single scale 36. The scale 36 and scale 27 abut in closed position (see FIG. 1) to define one side of the knife 10 at the handle portions 16, 17. The combined size and shape of scales 27, 36 is about equal to larger scale 28 (see FIG. 3).

Figure 3:
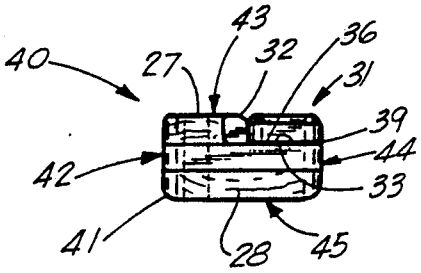
FIG. 3 is an end view taken along lines 3—3 of FIG. 2.

FIG. 3 shows an end view of knife 10 in closed position. Recess 31 is defined by vertical surface 33 and transverse surface 32 of larger handle portion 16. The recess 31 is preferably sized and shaped to the outer dimensions and shape of smaller handle portion 17. Thus, when knife 10 is collapsed to the closed position of FIG. 1, smaller handle 17 fits into recess 31. Smaller handle 17 has an upper surface 37, a lower surface 38 and a rear flat surface 39. In closed position, upper surface 37 conforms to lower surface 32 of scale 27, lower surface 38 aligns with lower edge 30 of larger handle portion 16, and flat rear surface 39 closely abuts and conforms to flat surface 33 which is of equal size and shape. The combined scales 36 and 27 thus are of about equal size and shape to scale 28.

A composite knife handle 40 is thus formed in closed position as shown in FIGS. 1 and 3. The composite handle is generally rectangular or square in transverse section and provides a generally continuous outer surface 41 that includes surfaces 42–45. The surfaces 42–45 extend longitudinally from pivot 15 to the butt end 46 of knife 10.

The following table lists the part numbers and part descriptions as used herein and in the drawings attached hereto.

PARTS LIST

| Part Number | Description |
|---|---|
| 10 | knife apparatus |
| 11 | larger knife portion |
| 12 | smaller knife portion |
| 13 | larger blade |
| 14 | smaller blade |
| 15 | pivot |
| 16 | larger handle portion |
| 17 | smaller handle portion |
| 18 | convex cutting edge |
| 19 | upper edge |
| 20 | concave recess |
| 20A | cutting edge |
| 21 | semicircular edge |
| 22 | point |
| 23 | rear of larger blade |
| 24 | upper edge |
| 25 | point |
| 26 | convex cutting edge |
| 27 | handle scale |
| 28 | handle scale |
| 29 | upper edge |
| 30 | lower edge |
| 31 | recess |
| 32 | lower surface |
| 33 | planar surface |
| 34 | object to be cut |
| 35 | rear of smaller blade |
| 36 | smaller handle scale |
| 37 | upper surface |
| 38 | lower surface |
| 39 | rear surface |
| 40 | composite handle |
| 41 | outer surface |
| 42 | surface |
| 43 | surface |
| 44 | surface |
| 45 | surface |
| 46 | end |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A cutting knife apparatus comprising:

a) a knife main body having a first larger handle and a first larger blade member, the first larger blade member having a cutting edge along its length;

b) a knife secondary body having a second smaller handle and a second blade member that is shorter than the first larger blade member, the second blade member having a lower cutting edge and an upper edge that each terminate at a common point;

c) a pivot mounted on the knife main body for pivotally joining the main body and primary body;

d) the main and secondary bodies being pivotally movable relative to one another between folded and extended positions;

e) the main and secondary bodies each having cooperating abutting surfaces that closely engage when in the folded position;

f) the cutting edge of the second blade member and the upper edge of the first blade member having a pair of shearing surfaces for cutting objects placed therebetween in the extended position, and when the blade members are moved toward the folded position;

g) the first and second handles nesting together with the second smaller handle abutting a recess of the first larger handle in the folded position to form a single handle member with a generally continuous outer surface that can be gripped by the hand of a user and defining an envelope, each of the handle members having corresponding abutting surfaces that closely conform within the envelope substantially along the length of each handle member in the folded position;

h) wherein the first and second blades each have corresponding side portions that abut in the folded position; and i) the larger blade having a concave recess that extends along its upper edge opposite the covering edge a partial distance from a position adjacent the pivot and forward the point of the larger blade, and the smaller blade extending beyond the concave Recess.

2. The knife apparatus of claim 1 wherein the first larger blade has a convex cutting edge.

3. The knife apparatus of claim 1 wherein the second blade member has a convex cutting edge.

4. The knife apparatus of claim 1 wherein the main body includes a generally flat body member and a pair of scales positioned on opposing sides of the flat body member.

5. The knife apparatus of claim 4 wherein the flat body member is metallic.

6. The knife apparatus of claim 1 wherein the knife secondary body includes a generally flat body member and at least one scale attached thereto.

7. A cutting knife apparatus comprising:

a) a knife main body having a first handle and a first larger blade member integral therewith, the first larger blade member having an upper edge and a lower cutting edge along its length;

b) a knife secondary body having a second handle and a second blade member that is shorter that the first blade member, the second blade member having a lower cutting edge and an upper edge that each terminate at a common point;

c) a pivot mounted on the knife main body for pivotally joining the main body and primary body;

d) the main and secondary bodies being pivotally movable relative to one another between folded and unfolded positions and wherein the second blade member pivots away from the upper edge of the first blade member so that the second blade member cutting edge faces the upper edge of the first blade member when the main and secondary bodies are unfolded relative to one another;

e) the main and secondary bodies each having cooperating abutting surfaces that closely engage when in the folded position;

f) the cutting edge of the second blade member and the upper edge of the first blade member defining a pair of shearing surfaces for cutting objects placed therebetween in the unfolded position, and when the blade members are moved toward the folded position;

g) the first and second handles nesting together in the folded position to form a single handle member with a generally continuous outer surface that can be gripped by the hand of a user and defining an envelope, each of the handle members having corresponding abutting surfaces that closely conform within the envelope substantially along the length of each handle member in the folded position; and h) wherein the first and second blades each have corresponding side portions that abut in the folded position.

8. The knife apparatus of claim 7 wherein the first larger blade has a convex cutting edge.

9. The knife apparatus of claim 7 wherein the second blade member has a convex cutting edge.

10. The knife apparatus of claim 7 wherein the main body includes a generally flat body member and a pair of scales positioned on opposing sides of the flat body member.

11. The knife apparatus of claim 7 wherein the flat body member is metallic.

12. The knife apparatus of claim 7 wherein the knife secondary body includes a generally flat body member and at least one scale attached thereto.

13. The knife of claim 1 or 7 wherein the second blade member has an upper surface with a cutting edge that can cut independently of the first blade member when the knives are in an open position.

14. The knife of claims 1 or 7 wherein the handle has arcuate grooves for gripping by a users fingers.

15. The knife of claim 1 or 7 wherein the second blade has an upper surface with a cutting edge thereon that extends along the upper surface a partial distance.

* * * * *